US005094214A

United States Patent [19]

Kotzan

[11] Patent Number: 5,094,214

[45] Date of Patent: Mar. 10, 1992

[54] VEHICLE ENGINE FUEL SYSTEM DIAGNOSTICS

[75] Inventor: Joseph M. Kotzan, Clarkston, Mich.

[73] Assignee: General Motors Corporation, Detroit, Mich.

[21] Appl. No.: 710,640

[22] Filed: Jun. 5, 1991

[51] Int. Cl.[5] ..... F02D 41/22

[52] U.S. Cl. ..... 123/479; 123/489

[58] Field of Search ..... 123/479, 489, 440

[56] References Cited

U.S. PATENT DOCUMENTS

| | | | |
|---|---|---|---|
| 4,306,529 | 12/1981 | Chiesa et al. | 123/440 |
| 4,309,971 | 12/1982 | Chiesa et al. | 123/480 |
| 4,502,443 | 3/1985 | Hasegawa et al. | 123/440 |
| 4,638,658 | 1/1987 | Otobe | 123/440 |
| 4,644,920 | 2/1987 | Abe et al. | 123/479 |
| 4,671,107 | 6/1987 | Chiesa et al. | 73/118.2 |
| 4,671,243 | 6/1987 | Deutsch | 123/440 |
| 4,850,324 | 7/1989 | Furuyama | 123/479 |

*Primary Examiner*—Andrew M. Dolinar
*Attorney, Agent, or Firm*—Howard N. Conkey

[57] ABSTRACT

The fuel system of an internal combustion engine diagnosed based on a learn term adjusted in response to a closed loop adjustment of the air fuel ratio and which is used along with the closed loop adjustment to determine the fuel amount supplied to the engine. The learn term is adjusted at a first rate based on the integral correction term. If the learn term reaches a predetermined primary rich or lean limit value and the closed loop integral adjustment reaches its authority limit, the learn term is further adjusted at a second rate that is slower than the first rate. When the learn term exceeds a predetermined secondary rich or lean limit value representing an adjustment that is greater than the adjustment represented by the corresponding primary rich or lean limit value, a fuel system fault is indicated.

3 Claims, 2 Drawing Sheets

VEHICLE ENGINE FUEL SYSTEM DIAGNOSTICS

BACKGROUND OF THE INVENTION

This invention relates to a system for diagnosing the fuel system of an internal combustion engine.

Engine fuel control systems generally include closed loop control of the air/fuel ratio of the mixture supplied to the engine. In these systems, an oxygen sensor monitors the engine exhaust gases and provides an indication of the rich or lean status of the air/fuel mixture relative to the stoichiometric ratio. Integral and proportional correction terms are generated from the oxygen sensor output and summed to generate a closed loop correction term used in computing the fuel amount injected into the engine to maintain the stoichiometric ratio. In addition to this closed loop correction term, many systems also employ a long term calibration adjustment used in computing the fuel amount injected into the engine. This long term correction term, sometimes referred to as a block learn term, provides for an open loop trim on the fuel calculation to adjust for such things as system aging, system-to-system variations or changes in vehicle operating conditions. It is typical for a separate block learn term to be generated for each of several engine operating points each of which is defined, for example, by a specific combination of engine speed and load. The learn term for each operating point is derived from the integral term portion of the closed loop correction term and is adjusted over time so that corrections made by the integral term are minimized. In other words, the integral term correction is transferred to the learn term.

SUMMARY OF THE INVENTION

In general, this invention provides for diagnosing the fuel system of an internal combustion engine based on the learn term set forth above. More specifically, the engine fuel system is diagnosed by monitoring the amount of the learn term.

In one aspect of the invention, when the learn term is adjusted to a value beyond a first limit threshold, a fault in the fuel system is indicated.

In yet another aspect of the invention, the learn term is adjusted at a first rate based on the integral correction term. If the learn term reaches a predetermined primary rich or lean limit value and the integral term reaches its authority limit, the learn term is further adjusted at a second rate that is slower than the first rate rate. When the learn term exceeds a predetermined secondary rich or lean limit value representing an adjustment that is greater than the adjustment represented by the corresponding primary rich or lean limit value, a fuel system fault is indicated.

In another aspect of the invention, the learn value is limited at its primary limit when the integral term is less than its authority limit.

The system for providing a fault indication based on the learn term in accord with this invention provides an indication of various fuel system faults including air leaks and drippy injectors.

DESCRIPTION OF THE DRAWINGS

The invention may be best understood by reference to the following description of a preferred embodiment and the drawings in which:

Referring to FIG. 1, an internal combustion engine 10 includes a conventional fuel delivery system wherein a fuel injector is provided for each one of the engine cylinders. This form of fuel delivery system is commonly referred to as a port fuel injection system. Air is drawn into the intake manifold of the engine 10 via an intake throttle bore 12 having an operator controlled throttle therein for regulating air flow into the engine 10. Air and the fuel provided by the fuel injectors are drawn into the engine cylinders where the mixture undergoes combustion to develop driving torque delivered to the driven wheels of the vehicle. The combustion gases from the cylinders are discharged into an exhaust conduit 14, which includes a conventional three-way catalytic converter 16, and then to the atmosphere. The engine 10 is controlled by an electronic controller 18. This controller takes the form of a standard digital computer such as a Motorola MC68HC11 microcomputer along with the standard interface and driver circuits for interfacing and conditioning the input and output signals.

The electronic controller 18 provides for control of the fuel injectors of the engine for injecting fuel to each of the respective cylinders of the engine 10 in timed relation to engine rotation. In general, the fuel injectors are controlled in response to various engine and vehicle operating parameters to achieve a scheduled air/fuel ratio. These parameters include a signal MAF representing the mass air flow output signal of a conventional mass air flow sensor measuring the air intake through the throttle bore 12 of the engine 10, an engine speed signal REF provided in any conventional manner such as by an ignition system distributor in timed relation to engine rotation and having a frequency directly proportional to engine speed, and the air/fuel ratio output signal of a conventional oxygen sensor 19 positioned in the exhaust manifold of the engine 10 for monitoring the air/fuel ratio of the mixture supplied to the engine combustion chambers. The air/fuel ratio signal is utilized to provide for closed loop adjustment of the air/fuel ratio of the mixture supplied to the engine so as to provide a stoichiometric ratio.

As will be described, the electronic controller 18 further provides for diagnosing the fuel system of the engine 10 and provides an output to a warning light to alert the vehicle operator to a sensed fault condition of the engine fuel system.

Figure 1:
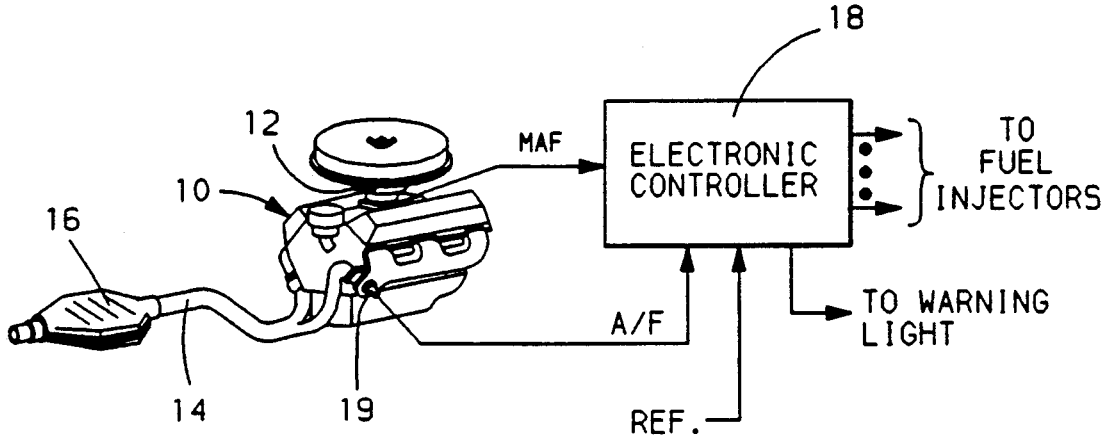
FIG. 1 illustrates the general form of a fuel control system for a vehicle port fuel injected internal combustion engine.
Figure 2:
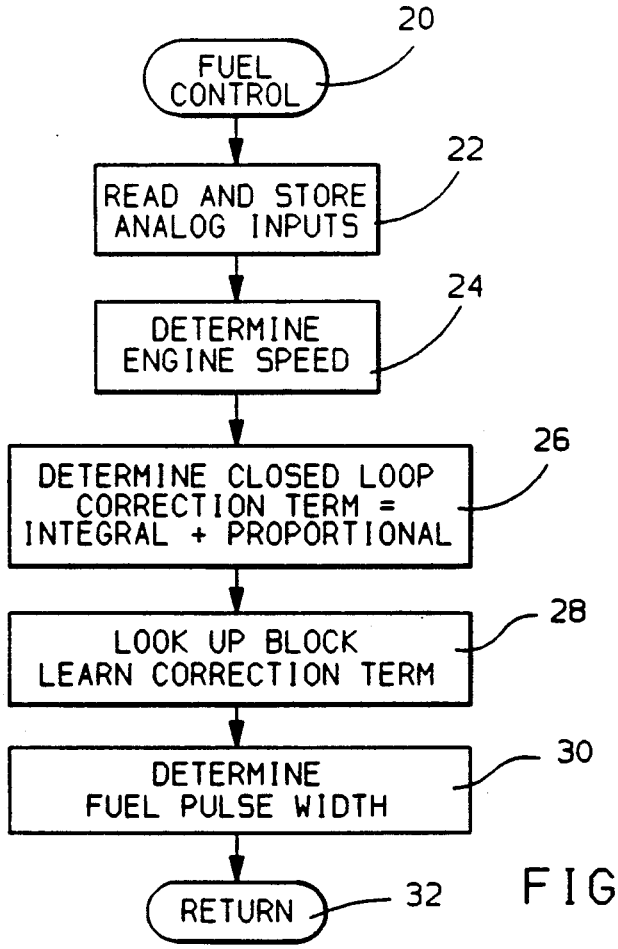
FIGS. 2 and 3 are flow diagrams illustrating the operation of the electronic controller of FIG. 1 in accord with the principles of this invention.
Figure 3:
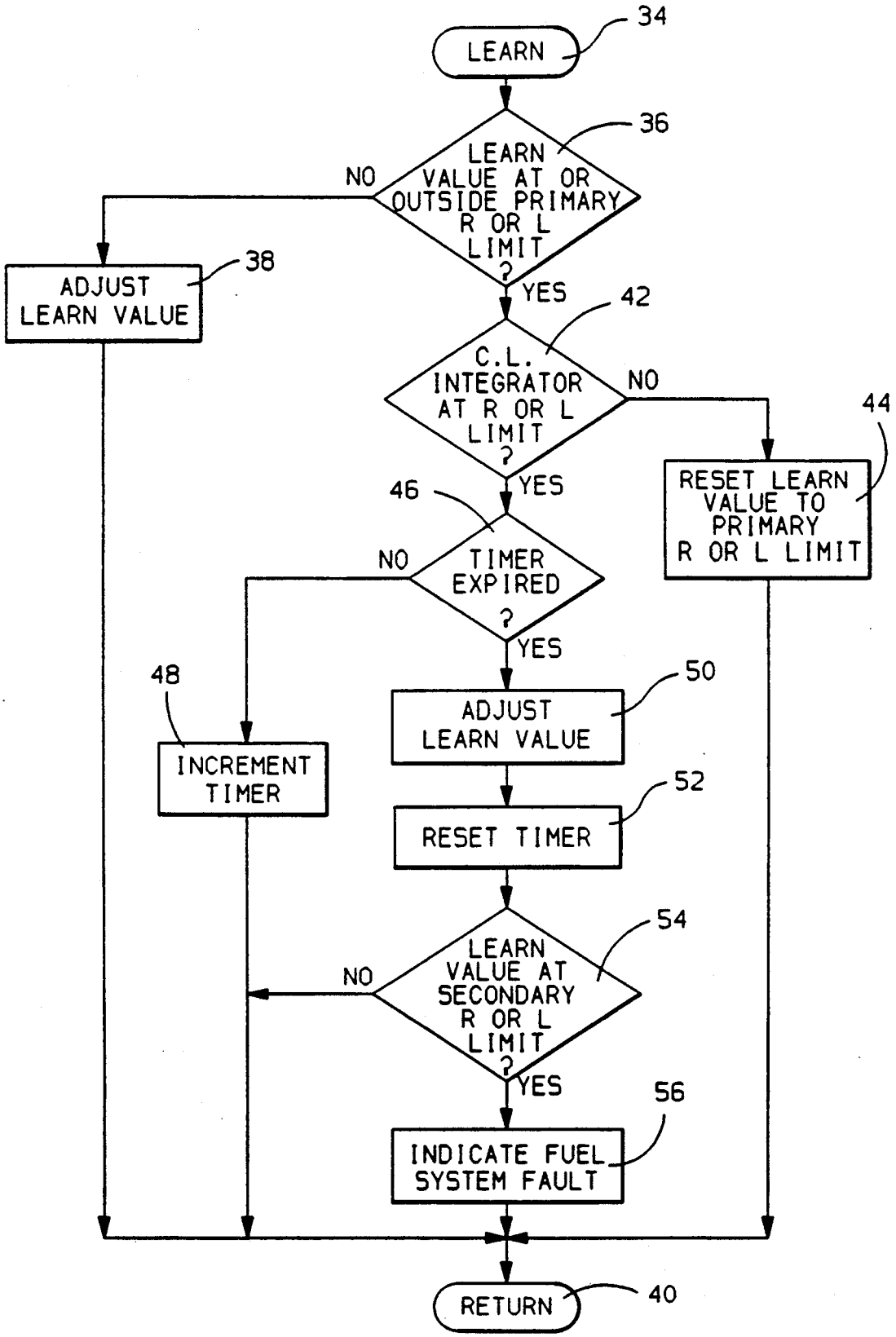

The operation of the electronic controller 18 in controlling the injection of fuel to the engine 10 and for diagnosing the fuel system is illustrated in FIGS. 2 and 3. The microcomputer contained within the electronic controller 18 has stored therein the instructions necessary to implement the algorithms as diagrammed in those figures. When power is first applied to this system from a vehicle battery (not shown) the computer program is initiated. The program may first provide for initialization of various random access memory variables to calibrated values and other functions. When this initialization routine is completed, a background loop may be executed that contains various system maintenance and diagnostic routines. This loop may be interrupted by one of possibly several system interrupts whereby control will be shifted to the appropriate interrupt service routine. In this embodiment, one such system interrupt is a high frequency interrupt provided at, for example, 3.125 millisecond intervals whereby a fuel control routine as illustrated in FIG. 2 is executed and another system interrupt is a lower frequency interrupt provided at, for example, 100 millisecond intervals during which a learn routine is executed as illustrated in FIG. 3.

Referring first to FIG. 2, the fuel control routine is generally illustrated that is repeatedly executed in response to the first interrupt that is generated at the first interval such as at the 3.125 millisecond interval. This routine generally provides for determining the fuel injection pulse width to be applied to the appropriate fuel injector of the engine 10. This routine is entered at point 20 and then at step 22 proceeds to read and save the values of the various analog input signals including the mass air flow signal MAF representing the mass air flow into the engine 10 and the value of the air/fuel ratio signal representing the rich or lean condition of the air/fuel ratio of the mixture supplied to the engine relative to the stoichiometric ratio. Thereafter, the routine determines the engine speed at step 24 based upon the frequency of the reference pulses REF. In one embodiment, the time between the reference pulses REF is determined to provide a measure of engine speed.

At step 26, the routine determines a closed loop correction term in the form of a multiplier that trims a computed fuel pulse width. The closed loop correction term provides means for the fuel controller to maintain a constant stoichiometric air/fuel ratio. In general, if the air/fuel signal indicates a lean mixture, the closed loop correction term is adjusted in direction to cause a richer mixture to be delivered to the engine cylinders. Likewise, if the air/fuel ratio signal is indicating a rich mixture, the closed loop correction term is adjusted in direction to cause a leaner mixture to be delivered to the engine cylinders. The resulting correction term is the multiplier that is some value greater than 1 to increase the fuel injection pulse width otherwise determined and some value less than 1 to decrease the fuel injection pulse width otherwise determined. The closed loop correction term is comprised of the sum of an integral correction term and a proportional correction term. The integral term is updated at step 26 based on the state of the air/fuel signal. If the oxygen sensor signal indicates a rich mixture, the integral term is decreased by a predetermined calibrated amount. Conversely, if the air/fuel signal indicates a lean mixture, the integral term is increased by a predetermined calibrated amount The proportional term of the closed loop correction term is comprised of a predetermined calibration value subtracted from the integral term when the air/fuel ratio signal indicates a rich air/fuel mixture and that is added to the integral term if the air/fuel ratio signal indicates a lean air/fuel ratio. As indicated, the sum of these terms provides for the closed loop correction of the otherwise determined fuel injection pulse width in response to the rich/lean state of the mixture as sensed by the oxygen sensor 19 so as to establish a stoichiometric air/fuel ratio.

The fuel control algorithm of this invention further includes a block learn term in the form of a multiplier for providing a trim on the fuel pulse width calculation so as to compensate for factors such as system-to-system variations or changes in the engine operating characteristics over time. In this embodiment, the fuel algorithm provides for a predetermined number of variables, such as 16, stored in a look-up table in memory at memory locations referred to as block learn memory cells. The individual memory cells are selected or addressed on the basis of the mass air flow rate represented by the mass air flow measured at step 22 and engine speed as computed at step 24. In this embodiment, three air flow values define the block learn memory cell boundary parameters on the air flow axis and three engine speed values define the block learn boundary parameters on the engine speed axis. The six block learn cell boundaries divide the air flow/engine speed plane into sixteen individual operating regions which correspond to the 16 block learn cells utilized in this embodiment. A particular cell is selected via step 28 by execution of a lookup routine when the engine operating point on the air flow/engine speed plane lies within the region corresponding to that cell. The value retrieved from the memory cell addressed by the measured values of mass air flow and engine speed comprise the block learn term multiplier.

As will be described, the block learn term in each cell is updated when the engine is operating in the corresponding engine operating region so as to provide a trim factor that is adjusted over time so that corrections required via the integral term of the closed loop correction term established at step 26 are minimized.

After retrieving the block learn correction term from the block learn memory cell corresponding to the engine operating region represented by the speed and load conditions, the program proceeds to step 30 where the fuel injection pulse width to be applied to the appropriate fuel injector for controlling the fuel quantity delivered to the engine 10 is determined. In general, this determination provides for an open loop computation of the fuel pulse width based on the mass air flow measured at step 22 and the desired air/fuel ratio multiplied by the closed loop correction term determined at step 26 and the block learn correction term retrieved from memory at step 28. It is assumed for purposes of describing this invention that the fuel control routine is functioning during a warmed-up engine condition whereby the desired air/fuel ratio is a stoichiometric ratio such that the correction terms applied provide for closed loop control of the air/fuel ratio to that ratio. Thereafter, the routine exits the fuel control routine at step 32 and returns to the background loop.

Referring to FIG. 3, there is described the routine executed in response to the 100 millisecond interrupt to update the block learn correction terms in the block learn memory utilized at step 28. Referring to FIG. 3, this learn routine is entered at step 34 and proceeds to a step 36 where the block learn value at the block learn cell corresponding to the engine operating region defined by the measured engine speed and engine mass air flow is compared to a primary rich or lean limit. This primary rich or lean limit defines the normal control authority or allowed limit of adjustment of the learn term utilized at step 28. If the learn value at the memory cell corresponding to the present engine operating point is less than the limit, the program proceeds to a step 38 where the learn value at the memory cell corresponding to the present engine operating region is updated based upon the closed loop integral term previously described. In one embodiment, the block learn memory cell corresponding to the present engine operating region is updated by comparing the state of the closed loop integral correction term with the air/fuel ratio signal rich/lean indication. The value stored in the block learn cell corresponding to the current engine operating point is then adjusted by a predetermined calibration amount in the direction increasing the fuel amount if the closed loop integral correction term is greater than a predetermined value when the air/fuel ratio signal indicates a lean air/fuel ratio and conversely the value stored in the block learn cell corresponding to the current engine operating region is shifted in direction to lean the air/fuel mixture if the closed loop integral correction term is less than a predetermined value while the air/fuel ratio signal indicates a rich air/fuel ratio. The effect of the adjustment of the block learn value at the block learn cell corresponding to the engine operating region is to decrease the correction required by the integral term of the closed loop controller when the engine is operating in that region in order to maintain the desired stoichiometric air/fuel ratio. By continued adjustment of this value over time, the integral term correction required to establish the stoichiometric ratio at this engine operating point is transferred to the calibration block learn term Following step 38 the routine exits the learn routine at step 40.

In accord with this invention, the block learn values stored in the various block learn cells via step 38 are utilized to diagnose a failure in the fuel system of the internal combustion engine 10. In general, if the block learn value corresponding to the current engine operating region is at the primary rich or lean authority limit and the system further determines that the closed loop integral term adjustment is at its authority limit indicating a condition wherein the system is incapable of maintaining a stoichiometric air/fuel ratio, the block learn value is then further adjusted at a slower rate. If the block learn term then attains a predetermined secondary rich or lean adjustment authority limit value greater than the primary limit value while the integrator remains at its authority limit, a fuel system fault condition is indicated.

Returning now to step 36, if it is determined that the block learn value stored in the block learn memory cell corresponding to the present engine operating point is at its rich or lean authority limit, the program proceeds to a step 42 to determine if the closed loop integral term established at step 26 is at its rich or lean authority limit at which it can exert no further adjustment to maintain a stoichiometric ratio. Assuming that the integrator is not at its authority limit, the program proceeds to a step 44 where the learn value at the block learn cell corresponding to the engine operating point is set to its primary rich or lean authority limit. For example, if step 36 determines that the learn value is greater than or equal to the primary rich authority limit, step 44 establishes the value at the rich limit. If step 36 determines that the block learn value at the block learn cell corresponding to the current engine operating point is equal to or less than the primary lean authority limit, step 44 resets the learn value equal to the lean authority limit.

If step 36 indicates that the block learn value is at or outside of its primary rich or lean limit, and step 42 determines that the closed loop integrator is unable to provide the adjustment required to maintain a stoichiometric air/fuel ratio, the program proceeds to sample a timer at step 46. This timer has an initial value that functions to establish the slow rate of adjustment of the block learn value. If the timer has not expired, it is incremented at step 48 after which the program exits the routine.

When step 46 determines that the timer has expired, the program proceeds to step 50 where the learn value at the memory location addressed by the values of engine speed and mass air flow is adjusted in a manner identical to step 38 in direction to establish a stoichiometric air/fuel ratio. Thereafter, the timer is reset at step 52. If at any time the block learn value at the block learn cell corresponding to the engine operating region attains a secondary rich or lean limit value, while the closed loop integrator is at its authority limit, a fault condition is represented. This condition is sensed at step 54 where the learn value retrieved from the learn cell corresponding to the engine operating region is compared to a secondary rich or lean authority limit. If these limits are not exceeded, the program exits the routine at step 40. However, if the secondary limit has been attained, the program proceeds to a step 56 where a fuel system fault condition is indicated. This fault condition may result from many different fuel system faults such as air leaks and leaky fuel injectors.

If at any time prior to the learn value attaining the secondary rich or lean authority limit step 42 indicates that the closed loop integral term is capable of adjustment of the fuel pulse width so as to attain a stoichiometric ratio indicating the fuel control system is in control of the air/fuel ratio, the block learn value at the engine operating point is reset to the primary rich or lean limit at step 44 as previously described. Therefore, it can be seen that a fault condition is indicated only when step 42 indicates the closed loop adjustment is out of control and thereafter the block learn value is adjusted from primary limit to the secondary authority limit.

While a specific preferred embodiment has been described, it is understood many modifications may be made by the exercise of skill in the art without departing from the scope of the invention The embodiments of the invention in which an exclusive property or privilege is claimed are defined as follows:

1. A method of control and diagnosing faults in a fuel system of an internal combustion engine comprising the steps of:

supplying an air and fuel mixture to the engine;

monitoring the air/fuel ratio of the mixture supplied to the engine;

determining a closed loop correction to the air and fuel mixture supplied to the engine in response to the monitored air/fuel ratio, the closed loop correction including an integral term correction to the air and fuel mixture in direction to restore the air/fuel ratio to a desired air/fuel ratio, the integral term correction having an authority limit value;

adjusting a learn term correction to the air and fuel mixture in response to the integral term correction and in said direction to restore the air/fuel ratio to the desired air/fuel ratio;

adjusting the air and fuel mixture in accord with the closed loop and learn term corrections; and indicating a fault condition when both (1) the learn term correction attains a predetermined limit and (2) the integral term correction is at the authority limit value.

2. A method of control and diagnosing faults in a fuel system of an internal combustion engine comprising the steps of:

supplying an air and fuel mixture to the engine;

monitoring the air/fuel ratio of the mixture supplied to the engine;

determining a closed loop correction to the air and fuel mixture supplied to the engine in response to the monitored air/fuel ratio, the closed loop correction including an integral term correction to the air and fuel mixture in direction to restore the air/fuel ratio to a desired air/fuel ratio, the integral term correction having an authority limit value;

adjusting a learn term correction to the air and fuel mixture in response to the integral term correction and in said direction to restore the air/fuel ratio to the desired air/fuel ratio;

limiting the learn term correction to a primary limit when the integral term correction is less than the authority limit value;

further adjusting the learn term correction to the air and fuel mixture in said direction to restore the air/fuel ratio to the desired air/fuel ratio when both (1) the learn term correction has reached the primary limit and (2) the integral term correction is at the authority limit value;

adjusting the air and fuel mixture in accord with the closed loop and learn term corrections; and indicating a fault condition when the learn term correction attains a secondary limit that is outside the primary limit by a predetermined amount.

3. The method of claim 2 wherein the learn term correction to the air and fuel mixture is adjusted at a first rate when the learn term correction is less than the primary limit and at a second rate less than the first rate when both (1) the learn term has reached the primary limit and (2) the integral term adjustment is at the authority limit value.

* * * * *